US007707774B2

(12) United States Patent
Molnar et al.

(10) Patent No.: US 7,707,774 B2
(45) Date of Patent: May 4, 2010

(54) TACTICAL BUILDING DOOR OPENER

(75) Inventors: Kenneth Molnar, Ottawa (CA); Christopher Graham, Casselman (CA)

(73) Assignee: Allen—Vanguard Corporation (CA)

( * ) Notice: Subject to any disclaimer, the term of this patent is extended or adjusted under 35 U.S.C. 154(b) by 809 days.

(21) Appl. No.: 11/279,724

(22) Filed: Apr. 13, 2006
(Under 37 CFR 1.47)

(65) Prior Publication Data

US 2010/0071265 A1 Mar. 25, 2010

(30) Foreign Application Priority Data

Apr. 15, 2005 (CA) ..... 2504282

(51) Int. Cl.
*E05F 15/04* (2006.01)

(52) U.S. Cl. ..... 49/340; 49/279; 49/301; 49/339; 49/324; 49/140

(58) Field of Classification Search ..... 49/324, 49/339, 340, 345, 346, 347, 357, 379, 279, 49/281, 301, 139, 140
See application file for complete search history.

(56) References Cited

U.S. PATENT DOCUMENTS

| | | | | | |
|---|---|---|---|---|---|
| 974,750 | A * | 11/1910 | Clermont | 49/171 |
| 1,223,956 | A * | 4/1917 | Ganzenmuller | 49/301 |
| 1,328,979 | A * | 1/1920 | Becker | 49/301 |
| 3,600,856 | A * | 8/1971 | Burn | 49/324 |
| 4,365,442 | A * | 12/1982 | Speer | 49/346 |
| 4,660,324 | A * | 4/1987 | Nyenbrink | 49/340 |
| 5,375,374 | A * | 12/1994 | Rohraff, Sr. | 49/340 |
| 5,392,562 | A * | 2/1995 | Carambula | 49/346 |
| 5,910,075 | A * | 6/1999 | Arnell et al. | 49/25 |
| 7,373,756 | B2 * | 5/2008 | Okulov et al. | 49/346 |

* cited by examiner

*Primary Examiner*—Gregory J. Strimbu
(74) *Attorney, Agent, or Firm*—Hayes Soloway P.C.

(57) ABSTRACT

A portable, tactical building door opener comprises a door opening mechanism comprising: a body; a door opening arm pivotally connected to the body at a first end and having a roller for engaging the surface of the door at a second end; and an actuator for rotating the door opening arm with respect to the body, from a ready position in which the roller is not forced against the surface of the door, to a door-opened position in which the roller is forced against the surface of the door to open the door. The actuator is remotely and manually operable. The device further includes a support for temporarily and removably bracing the door opening mechanism with respect to the door.

14 Claims, 6 Drawing Sheets

TACTICAL BUILDING DOOR OPENER

FIELD OF INVENTION

The present invention relates to tactical tools and systems, and in particular to hook and line equipment used by first responders to access rooms that may expose them to danger by opening the door. The system for and method of the invention allows the first responder to unlatch a building door and open it from a safe location.

BACKGROUND OF THE INVENTION

There are many situations in which it may be desirable to open a closed door, but doing so may present a hazard to a person opening the door. For example:

police may wish to enter a building in which a gunman is hiding, firemen may wish to enter a burning building, not knowing the intensity or pressure of the flames behind the door, peace keepers may be searching for guerillas, not knowing whether doors are set to trigger explosives when opened, or a first responder may be investigating a report of a gas leak in a building.

In each of these cases, it would be highly desirable to open the door from a safe distance away, from around a corner, or from behind a shield of some sort. There is currently no effective method or system for doing this.

There are simple tools that can be used to unlatch a door from a distance, ranging from specialized clamps to duct tape and rope. Once a door is unlatched there are also simple methods used to push the door open including using a long poll or a rope. However, none of these methods offer a safe and comprehensive solution that can be operated reliably and effectively from a significant distance away, or from around a corner.

Robots can also be used to unlatch and open doors at a safe distance, but they are expensive and generally slow to deploy. If a region has access to a robot at all, it may be stored a significant distance away from where it is required and it takes time to locate the qualified operator, deliver it to the site and set it up. In many tactical situations, there simply is not enough time for all of this to be done. Also, given the dedicated design of most robots, they simply may not be effective in all situations.

"Hook and line" systems are available for tactical purposes, but these systems are intended more for guiding explosive devices around corners and other structural obstacles, so that they can be drawn out of buildings from a safe distance. None of these "hook and line" systems include effective methods or systems for opening doors from a remote or safe location.

Thus, there is a need for a method of and system for tactical door opening which allows the user or first responder to be a safe distance away, around a corner, or behind a shield. It is desirable that this method and system be reliable, effective and relatively inexpensive in comparison to robots and the like. As the method and system is intended for tactical situations, it is also desirable that it be self-contained, portable and easily set up while wearing bulky protective gear.

SUMMARY OF THE INVENTION

The present invention relates to a method of and system for tactical door opening, which obviates or mitigates at least one of the disadvantages of the prior art. Accordingly, it is an object of the invention to provide an improved building door opener.

One aspect of the invention is broadly defined as a portable, tactical building door opener for opening a door, comprising: a door opening mechanism comprising: a body; a door opening arm pivotally connected to the body at a first end and having a roller for engaging the surface of the door at a second end; and an actuator for rotating the door opening arm with respect to the body, from a "ready" position in which the roller is not forced against the surface of the door, to a "door-opened" position in which the roller is forced against the surface of the door to open the door; the actuator being remotely and manually operable; and support means for temporarily and removably bracing the door opening mechanism with respect to the door.

Another aspect of the invention is broadly defined as a portable, tactical building door opening system for opening a door, comprising: means for unlatching the door; a door opening mechanism comprising: a body; a door opening arm pivotally connected to the body at a first end and having a roller for engaging the surface of the door at a second end; and an actuator for rotating the door opening arm with respect to the body, from a "ready" position in which the roller is not forced against the surface of the door, to a "door-opened" position in which the roller is forced against the surface of the door to open the door; the actuator being remotely and manually operable; support means for temporarily and removably bracing the door opening mechanism with respect to the door; and means for operating the means for unlatching the door and the actuator manually and remotely.

A further aspect of the invention is broadly defined as a method of opening a building door comprising the steps of: mounting a portable, tactical building door opener to the frame of the door, the door opener comprising: a door opening mechanism comprising: a body; a door opening arm pivotally connected to the body at a first end and having a roller for engaging the surface of the door at a second end; and an actuator for rotating the door opening arm with respect to the body, from a "ready" position in which the roller is not forced against the surface of the door, to a "door-opened" position in which the roller is forced against the surface of the door to open the door; the actuator being remotely and manually operable; and support means for temporarily and removably bracing the door opening mechanism with respect to the door; and mounting a means for unlatching the door, to a handle of the door; routing a single line through the means for unlatching the door, and to the actuator on the door opening mechanism; and pulling the single line, thereby unlatching the door and operating the actuator so that it rotates the door opening arm from the "ready" position to the "door-opened" position.

This summary of the invention does not necessarily describe all features of the invention.

BRIEF DESCRIPTION OF THE DRAWINGS

These and other features of the invention will become more apparent from the following description in which reference is made to the appended drawings wherein.

DETAILED DESCRIPTION

Figure 1:
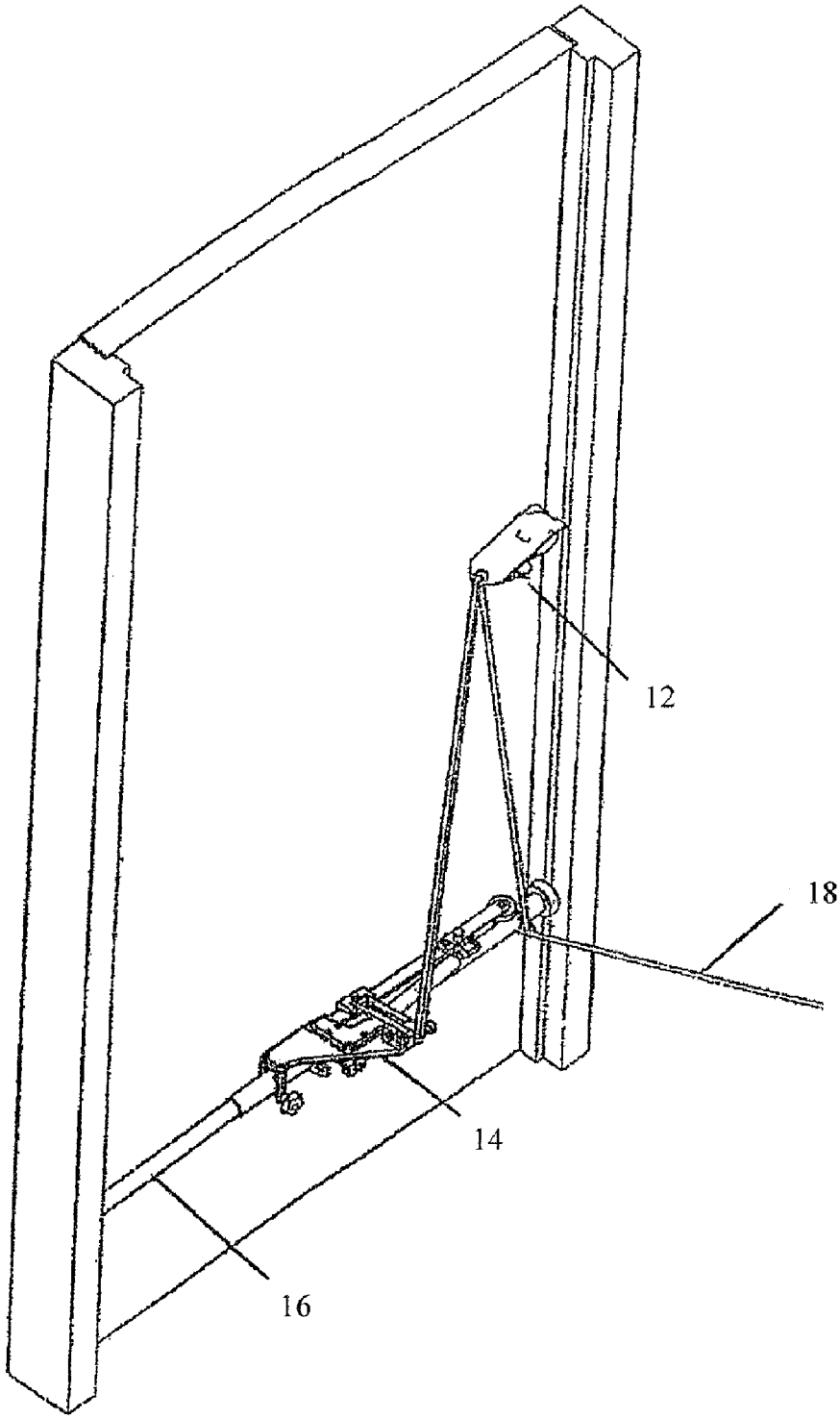
FIG. 1 presents a perspective view of an exemplary implementation of a door opener assembly, in a ready state.

A system that addresses one or more of the problems in the art is presented in FIGS. 1 through 6. This system consists of four major elements as shown in FIG. 1: a door handle gripping device 12, a door opening mechanism 14, a spreader bar 16 which supports the door opening mechanism 14, and a line 18 which loops through to operate both the door handle gripping device 12 and the door opening mechanism 14. The line 18 is extended to a safe location where the first responder can pull the line 18, causing the door to unlatch and be pushed open safely.

Figure 2:
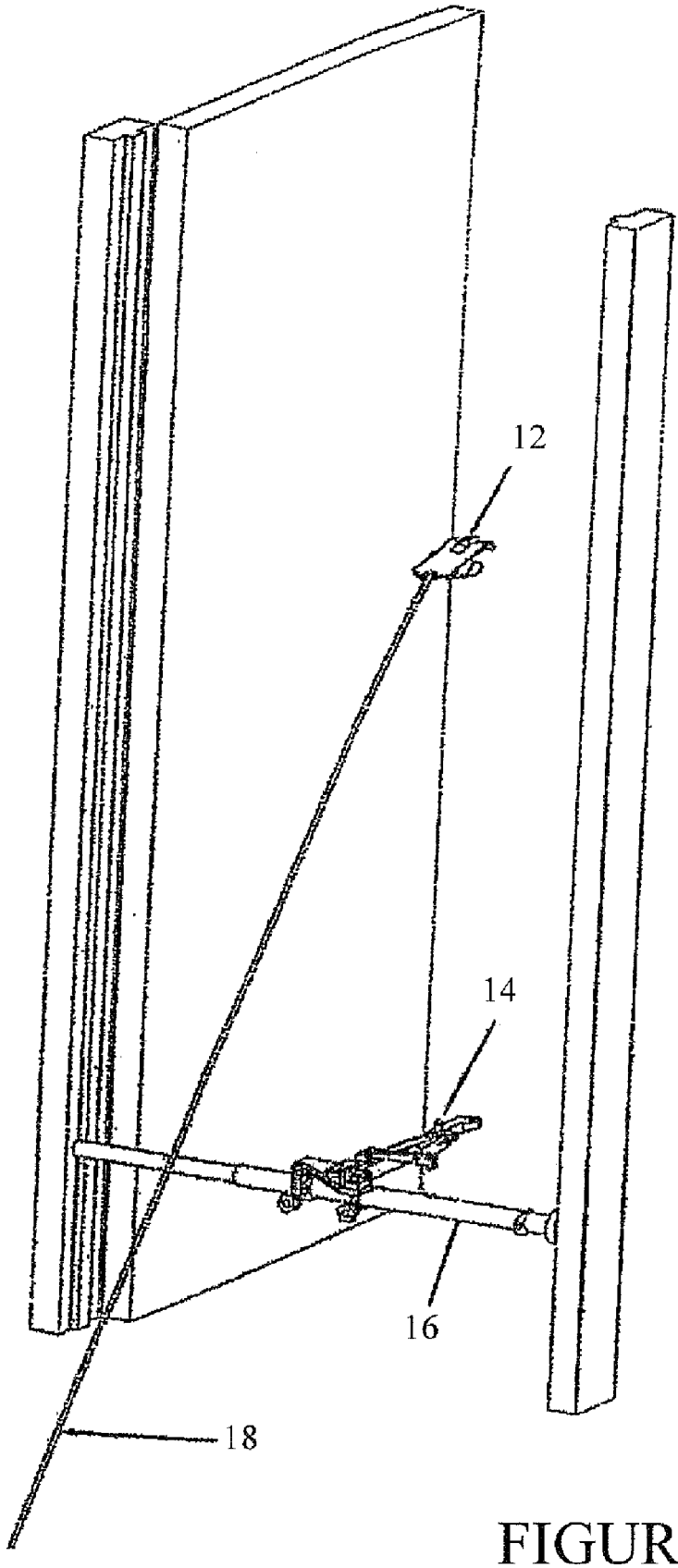
FIG. 2 presents a perspective view of an exemplary implementation of a door opener assembly, in a triggered state.
Figure 3A:
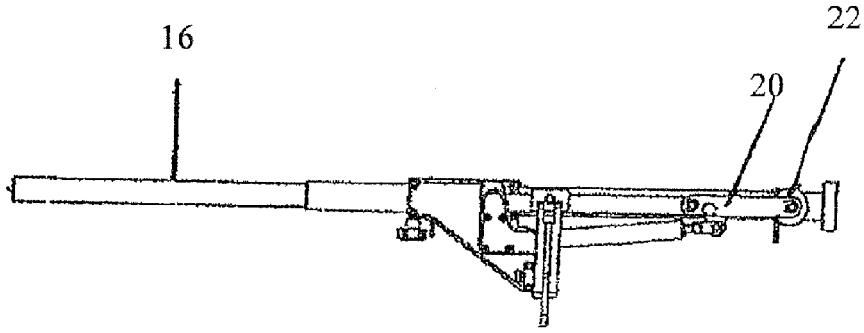
FIGS. 3A and 3B present plan views of a door opener assembly in an embodiment of the present invention, in "ready" and "door-opened" positions respectively.
Figure 3B:
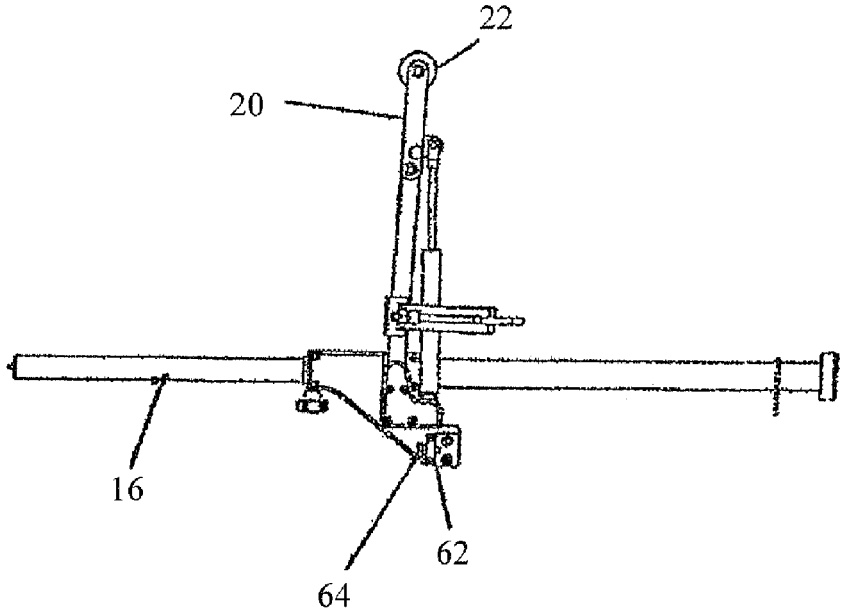

FIG. 1 presents this system in a "ready" steady, while FIG. 2 presents the "door-open" state, after triggering. That is, in FIG. 1, the door is closed and latched, and the door opening mechanism 14 has not yet been triggered. In FIG. 2, the door has been unlatched by rotating the door handle gripping device 12, and the door opening mechanism 14 has been triggered, forcing the door to open. FIG. 3A presents the door opening mechanism 14 in the "ready position" with a door opening arm 20 in a retracted position, generally parallel to the spreader bar 16 so that its roller 22 will not apply any force against the surface of the door. FIG. 3B presents the door opening mechanism 14 in the "door-open" position with the door opening arm 20 in a deployed position, generally perpendicular to the spreader bar 16, the roller 22 having applied force to the surface of the door and causing it to open. The roller 22 is used simply to reduce friction between the door opening arm 20 and the door.

Door handle gripping devices 12 are known in the art and any such device which is suited to the line system and arrangement being used, is acceptable. Typical door handle gripping devices 12 are not much more complex than a lever and a clamp, and indeed, even duct tape may be used to secure the line 18 to the door handle. The concepts of the invention may also be applied to crash bars or other door unlatching systems. The door handle gripping device 12 would be installed in the manner suited to the device being used and the situation.

Typically, the door opener (i.e. the spreader bar 16 and door opening mechanism 14 in combination) would be mounted in a doorframe engaging a hinge jamb and a latch jamb of the door frame near the bottom so it is out of the way. The door opening mechanism 14 is supported by the spreader bar 16 which is designed to fit a wide range of door sizes and styles.

Figure 4A:
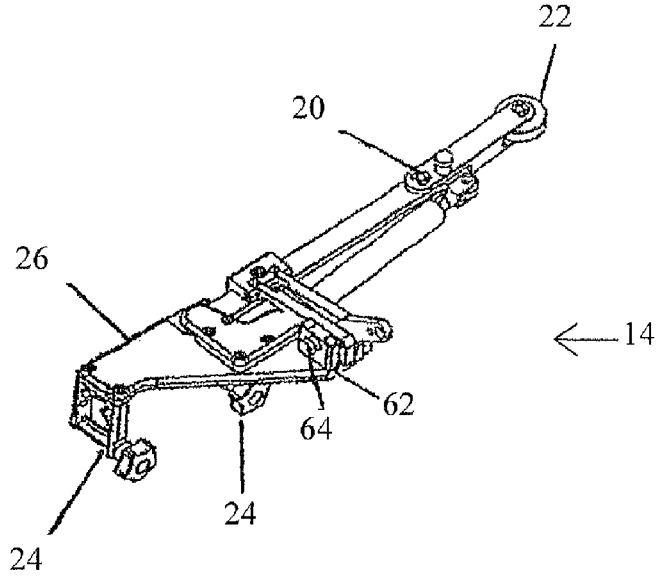
FIG. 4A presents a perspective view of a door opener mechanism in an embodiment of the present invention.
Figure 4B:
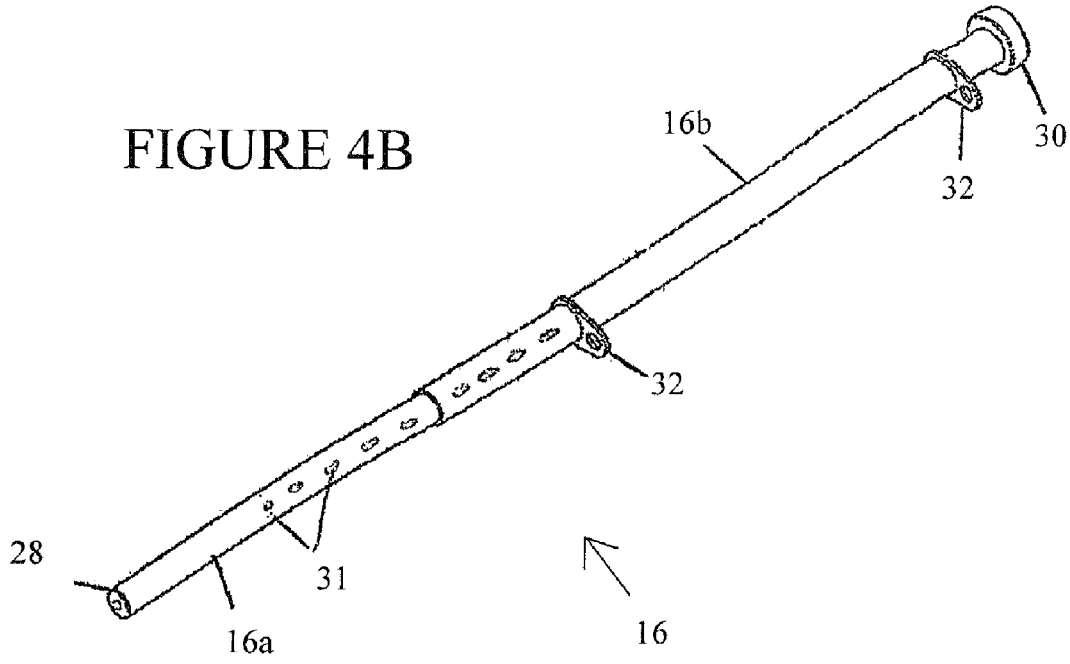
FIG. 4B presents a perspective view of a spreader bar in an embodiment of the present invention.

FIGS. 4A and 4B present respective views of the door opener mechanism 14 and the spreader bar 16 respectively. FIG. 4A clearly shows two knurled screw-clamps 24 which are used by the door opening mechanism 14 to grip the spreader bar 16. The two knurled screw-clamps 24 are mounted on the body 26 of the door opening mechanism 14. The spreader bar 16 can be supplied with sharp points at either end 28 or removable rubber feet 30 which are used to grip the door frame. The spreader bar 16 is also supplied with two eyes 32 which may be used as guides or anchors for the line 18. One eye 32 is used as a guide in FIG. 1, for example.

The spreader bar 16 could be implemented in a number of manners. Preferably, it consists of two tubes 16*a*, 16*b* which telescope together and have a number mating pairs of holes (31). A spring loaded button (not shown) is used to roughly establish the length of the spreader bar 16 and an internal thread at the end of one of the two tubes 16*a*, 16*b* used to complete the length adjustment. Alternatively, the spreader bar 16 could consist of two tubes 16*a*, 16*b* which telescope together and have an internal thread. Thus, by rotating one tube with respect to the other in the axis of the internal thread, the length of the spreader bar 16 can be adjusted so that it can be tightened securely into the door frame. Other manners of bracing the door opener could also be used, for example, by gripping a frame of the door, or mounting the door opener on the ground.

Figure 5:
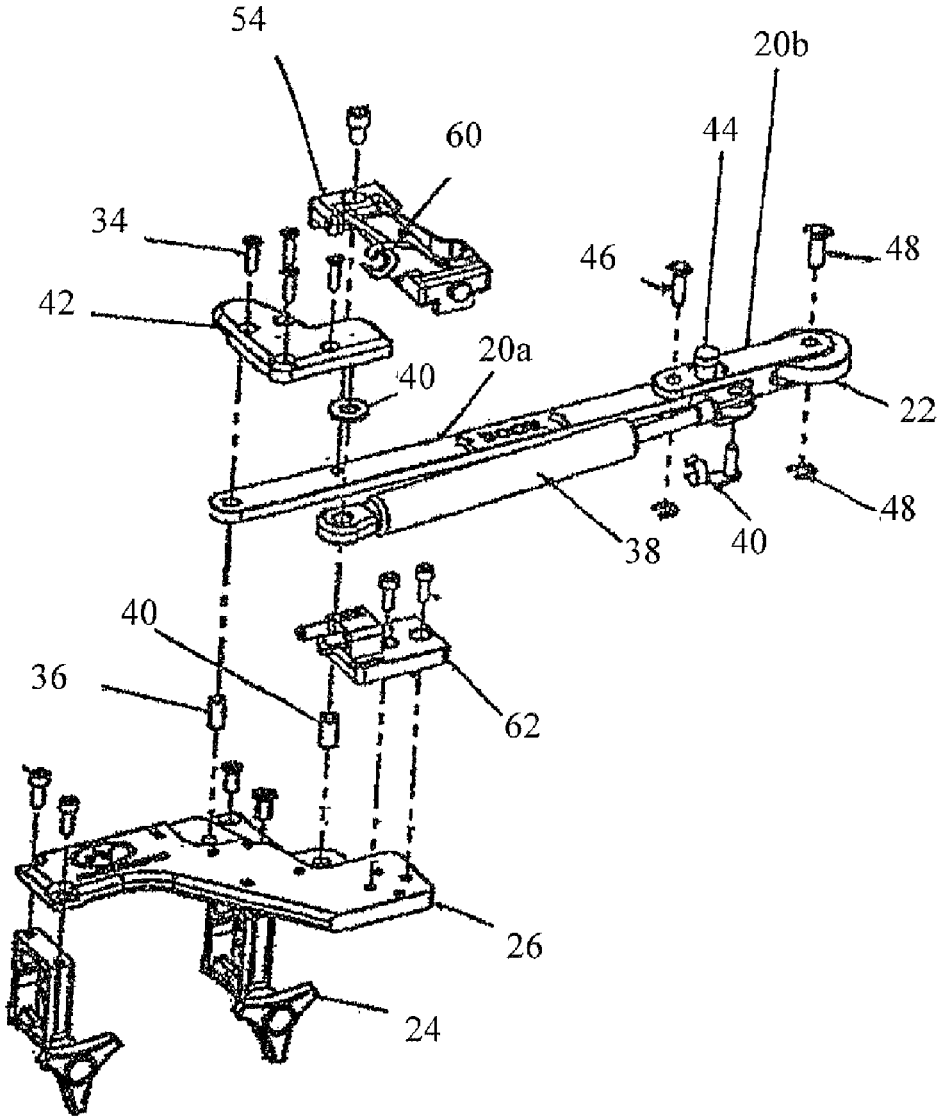
FIG. 5 presents an exploded perspective view of a door opener mechanism in an embodiment of the present invention.

FIG. 5 presents an exploded view of the door opener mechanism 14, showing the details of the design and assembly. As noted above, the body 26 of the door opener mechanism 14 is bolted to two knurled screw-clamps 24 which are used to grip the spreader bar 16. The door opening arm 20 is also connected to the body 26 using a pin 34 and sleeve 36, so that it can pivot between the ready and door-opened positions. A pneumatic cylinder 38 is used to actuate the door opening arm 20 and hence, open the door. The pneumatic cylinder 38 could be replaced with various arrangements of springs, hydraulic or gas cylinders, or some other form of actuator. The size and power of the actuator would also be determined by the nature of the application (i.e. the expected size and weight of the doors, and the leverage gained by the design).

The pneumatic cylinder 38 is also pivotally connected to the body 26 of the door opener mechanism 14 and pivotally connected to the door opening arm 20 using pins, sleeves and washers 40 as required. A plate 42 is used to hold the pneumatic cylinder 38 and the door opening arm 20 to the body 26 of the door opener mechanism 14. The roller 22 is also free to rotate at the end of the door opening arm 20, being fastened via an axle pin and retainer 48.

As shown in FIG. 5, the door opening arm 20 actually consists of two parts, 20*a*, 20*b*. This is done to facilitate a quick release pin 44, which can be used to release the pneumatic cylinder 38 from the door opening arm 20 in case there is a mechanical failure, the door jambs, or there is some similar problem. When the quick release pin 44 is inserted, the two parts 20*a*, 20*b* of the door opening arm 20 are held rigid with respect to one another, and when the pin 44 is removed, they are free to pivot about pin 46 and its retainer.

Figure 6:
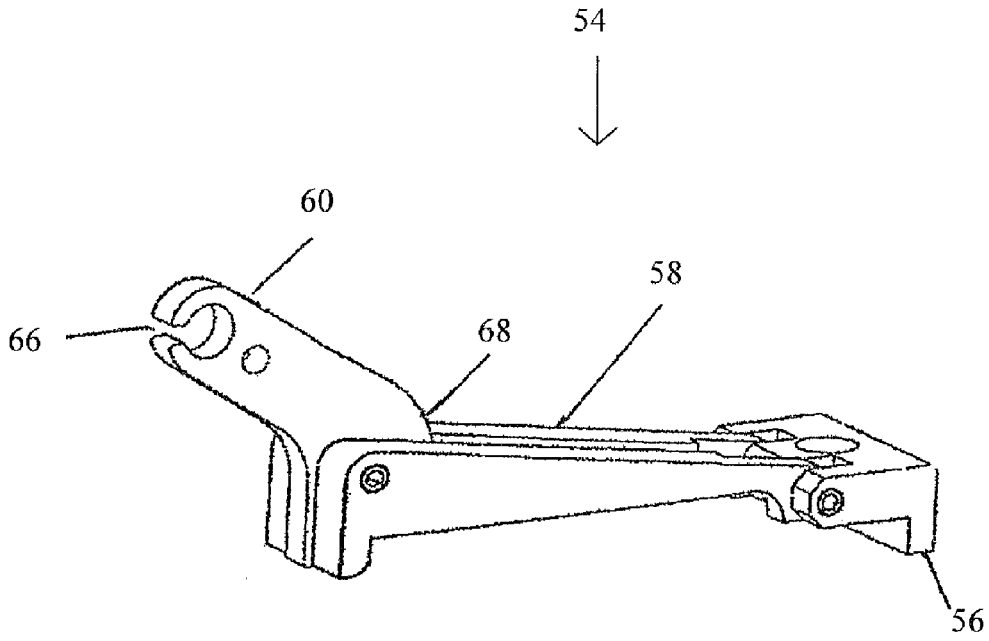
FIG. 6 presents a perspective view of a latch assembly in an embodiment of the present invention.

The latch assembly 54 is shown in greater detail in FIG. 6. It consists of a base 56 which is mounted to the door opening arm 20, a pivotally connected latch arm 58, and a pivotally connected trigger arm 60. When the pneumatic cylinder 38 is charged, the latch arm 58 and trigger arm 60 will bear against the shoulder of a release rest assembly 62 on the body 26 (see FIGS. 3*b*, 4*a* and 5). The release rest assembly 62 is provided with a safety pin 64 which can be used to lock the latch arm 58 and trigger arm 60 to the release rest assembly 62 while in the ready position, to prevent an accidental release. The pneumatic cylinder 38 is charged simply by manually pivoting the mechanism from the door-opened position to the ready position.

Two arrangements for the trigger 60 are shown in the figures, and of course, other arrangements could also be used. In FIG. 5, the trigger is oriented to pivot in a plane that is perpendicular to the plane that the latch arm 58 pivots in, while in FIG. 6, they both pivot in the same plane. In either case, the trigger 60 has a cam 68 which lifts the latch arm 58 from the shoulder of the release rest assembly 62. The arrangements are different to facilitate different doors and line 18 arrangements. For example, the trigger 60 of FIG. 5 is particularly well suited to a door in which the handle is on the right hand side as the greatest leverage and mechanical advantage is gained with the trigger 60 as far away from the door handle as possible. The trigger 60 could also be removed and re-installed in the opposite orientation to facilitate a door with a handle on the left hand side.

In use, a door handle gripping device 12 is attached to the door in such a way that by pulling a line 18 toward the door opening mechanism 14 will cause the door to unlatch. The line 18 is attached to the door handle gripping device 12. The door opening mechanism 14 is installed in the doorway with the gas cylinder latch arm 58 and trigger 60 in the ready or armed state. The line 18 is attached to the latch assembly 54 and from there may go to another eye or anchor point. The line 18 is then extended to a safe location. When the user pulls the line 18, the door handle is turned until it unlatches and does not turn any further. If the line 18 is pulled more the extra tension on the line 18 causes the latch arm 58 and trigger 60 to open, releasing the pneumatic cylinder 38 which is connected to door opening arm 20 that pushes the door open. The latch assembly 54 is designed so that it releases the line 18 to allow the door to swing open more freely. As shown in FIG. 6, for example, the latch assembly 54 could have a gap 66 that faces upward in the released position, so that the line 18 can simple pull out of the loop in the latch. Depending on the equipment available and the application, the line 18 may be installed in reverse order (i.e. run thought the anchors, through the latching mechanism and then attached to the door handle or door handle clamp).

Other features of the door opening mechanism, spreader bar and door handle gripper are shown in the attached figures.

By using this system the first responder can open a door from a safe location. Since the design is pneumatic and there are no electric parts this device can be designed in a way to work in explosive (gas) environments.

Exemplary Implementation

A first responder needs to open a door in a room that is potentially dangerous. The danger can be of any type including a gunman, explosives, gas, fire, etc. The first responder decides that he wants to open the door from a safer location around the corner. The first responder runs a line from around the corner to the door of interest. He installs the doorknob gripper and then installs the door opening mechanism near the floor. He then runs the line through an anchor point on the spreader bar, through the doorknob gripper, to the latching mechanism and then back to doorknob were clips it onto the doorknob gripper. He then goes to the safe zone (around the corner). When he decides to open the door he pulls on the line. This causes the doorknob to turn unlatching the door. By continuing to pull the triggers the release latch which releases the gas cylinder which pushes arm that pushes the door open. When the latch is triggered the line to the latch is released allowing the door to swing open more freely. The arm remains extended ensuring that the door remains open.

While the invention has been described in connection with specific embodiments and in specific uses, various modifications thereof will occur to those skilled in the art without departing from the spirit and scope of the invention as set forth in the appended claims.

All citations are hereby incorporated by reference.

What is claimed is:

1. A portable, tactical building door opener for opening a door, comprising:

a door opening mechanism comprising:

a body;

a door opening arm pivotally connected to said body at a first end of said arm and having a roller for engaging a surface of said door at a second end of said arm; and an actuator for rotating said door opening arm with respect to said body, from a ready position in which said roller is not forced against the surface of said door, to a door-opened position in which said roller is forced against the surface of said door and has moved said door to an open position;

said actuator being remotely and manually operable; and support means for temporarily and removably bracing said door opening mechanism with respect to a frame of said door, wherein said support means comprises a spreader bar positioned within said frame of said door and engaging a hinge jamb of said frame at one end of said bar and engaging a latch jamb of said frame at another end of said bar.

2. The door opener of claim 1, wherein said spreader bar interference fits within said frame of said door.

3. The door opener of claim 2, wherein said spreader bar comprises two mating tubes, said tubes having alignable mating holes and a spring-loaded button alignable with said holes.

4. The door opener of claim 2, wherein said spreader bar comprises a sharp point at said ends thereof for engaging with said door frame.

5. The door opener of claim 2, further comprising rubber feet which may be removably mounted on the ends of said spreader bar, for engaging with said door frame.

6. The door opener of claim 2, further comprising two adjustable clamps mounted on said body, for gripping said spreader bar.

7. The door opener of claim 2, wherein said actuator comprises a pneumatic cylinder.

8. The door opener of claim 7, wherein said pneumatic cylinder is pressurized by rotating said door opening arm from said door opened position to said ready position.

9. The door opener of claim 8, further comprising a latch mechanism to hold said pneumatic cylinder when pressurized.

10. The door opener of claim 9, wherein said latch mechanism is operated to release said pneumatic cylinder by pulling on a line.

11. The door opener of claim 2, wherein said actuator comprises a spring.

12. A portable, tactical building door opening system for opening a door, comprising:

means for unlatching said door;

a door opening mechanism comprising:

a body;

a door opening arm pivotally connected to said body at a first end of said arm and having a roller for engaging a surface of said door at a second end of said arm; and an actuator for rotating said door opening arm with respect to said body, from a ready position in which said roller is not forced against the surface of said door, to a door-opened position in which said roller is forced against the surface of said door and has moved said door to an open position;

said actuator being remotely and manually operable;

support means for temporarily and removably bracing said door opening mechanism with respect to a frame of said door; wherein said support means comprises a spreader bar positioned within said frame of said door and engaging a hinge jamb of said frame at one end of said bar and engaging a latch jamb of said frame at another end of said bar; and means for operating said means for unlatching said door and said actuator manually and remotely.

13. The building door opening system of claim 12, wherein said means for unlatching said door comprises a lever which is removably fastened to a knob on said door.

14. The building door opening system of claim 13, wherein said means for operating comprises a single line which is routed to operate said means for unlatching and said actuator when pulled.

* * * * *